United States Patent [19]

Millican et al.

[11] Patent Number: 4,737,740

[45] Date of Patent: Apr. 12, 1988

[54] DISCONTINUOUS-TAPER DIRECTIONAL COUPLER

[75] Inventors: George L. Millican, Dallas, Tex.; Joseph A. Mosko, Ridgecrest, Calif.

[73] Assignee: The United States of America as represented by the Secretary of the Navy, Washington, D.C.

[21] Appl. No.: 498,338

[22] Filed: May 26, 1983

[51] Int. Cl.[4] ..... H01P 5/18

[52] U.S. Cl. ..... 333/116; 333/238

[58] Field of Search ..... 333/116, 128, 238

[56] References Cited

U.S. PATENT DOCUMENTS 3,528,038 9/1970 Tresselt .
3,562,674 2/1971 Gerst .
3,575,674 4/1971 Howe, Jr. .
3,659,228 4/1972 Napoli ..... 333/116
3,768,042 10/1973 Friend et al. ..... 333/116
3,777,284 12/1973 Schultz .
3,815,055 6/1974 Plunk et al. .

*Primary Examiner*—Paul Gensler
*Attorney, Agent, or Firm*—Robert W. Adams

[57] ABSTRACT

A stripline coupler exhibiting higher coupling coefficients and improved scattering properties in the plus 10 Ghz range, utilizes a section of discrete areal dimension in each of two tapered striplines, such that said sections form a discontinuity in the taper, in conjunction with perforations of the bilateral ground planes coincident with each section. The dielectric separating each stripline from the ground plane is modified in the region of the perforations to reduce the dielectric constant in the region.

7 Claims, 5 Drawing Sheets

$Z_{Oe}/Z_O = 1.91682$ 1.79319

1.66976

$Z_{Oe}/Z_O = 2.70305$ 2.44720

2.19436
PRIOR ART

VIEW A-A

VIEW B-B

DISCONTINUOUS-TAPER DIRECTIONAL COUPLER

FIELD OF THE INVENTION

This invention relates to strip line microwave signal processing circuitry. More particularly, the invention relates to directional couplers used in strip line microwave signal processing circuitry. Even more particularly, the invention relates to design parameters of discontinuous-taper directional couplers which aid in controlling the electromagnetic scattering properties thereof.

BACKGROUND OF THE INVENTION

Strip transmission line microwave signal processing circuitry is commonly used in missile guidance and other similar applications requiring broad frequency coverage with functional versatility and economical manufacturing practices. The most significant physical phenomenon involved in strip line signal processing is the overtly imposed electrical interaction between two or more transmission lines or transmission line elements exhibited in the directional coupler.

The art strip line directional coupler design has evolved through the years as a result of the work of many contributors. In early days directional couplers were designed as interacting pairs of discrete transmission line sections (Cohn and others). Electrical length of the sections was set at one center frequency quarter wavelength. To broaden the frequency band width response it was necessary to implement the device as a sequence of such pairs with different mutual coupling coefficients. The practical problem of adapting the strip geometry to these requirements for progressively changing local coupling coefficients was methodically resolved through the use of a variable offset line geometry. Now, along with the push into frequency bands above 10 Ghz, has come the increasing incidence of severe degradation of the isolation and return loss operating characteristics. A major factor in causing the deterioration of performance with higher frequencies and broader band widths is found to be the requirement for high peak coupling coefficients coincident with an erratic distribution of currents laterally disposed on the offset line in the region near maximum coupling.

SUMMARY OF THE INVENTION

The discontinuous-taper directional coupler is designed for implementation in a three-dielectric-layer configuration in which the center layer is somewhat thicker relative to the total three-layer thickness than would have been the case in prior art. The conductive strip transmission lines are etched on both sides of the center dielectric, and local coupling is determined by the configuration parameters. In the past, it has been customary to shield the coupled lines, top and bottom, with continuous ground planes having no perforations or other means of communication with the space above or below the ground planes. The present invention provides a thicker center spacer to ameliorate the unbalanced lateral current distribution on the approach to full broadside coupling. Additionally and simultaneously, the method for achieving spikes of high maximum coupling coefficient is manifest in the use of a combination of dielectric modification and ground plane perforation which, by design, provide control of the even-mode capacitance without significant perturbation of the odd-mode capacitance in the region of highest coupling.

It is an object of this invention to provide a device which promotes intracircuit compatibility between dissimilar components having disparate requirements for maximum coupling values.

Another object of the invention is to improve the electromagnetic scattering properties of microwave strip line directional coupler technology to allow satisfactory operation up to 35 Ghz and beyond in frequency.

DESCRIPTION OF THE PREFERRED EMBODIMENT

Figure 8:
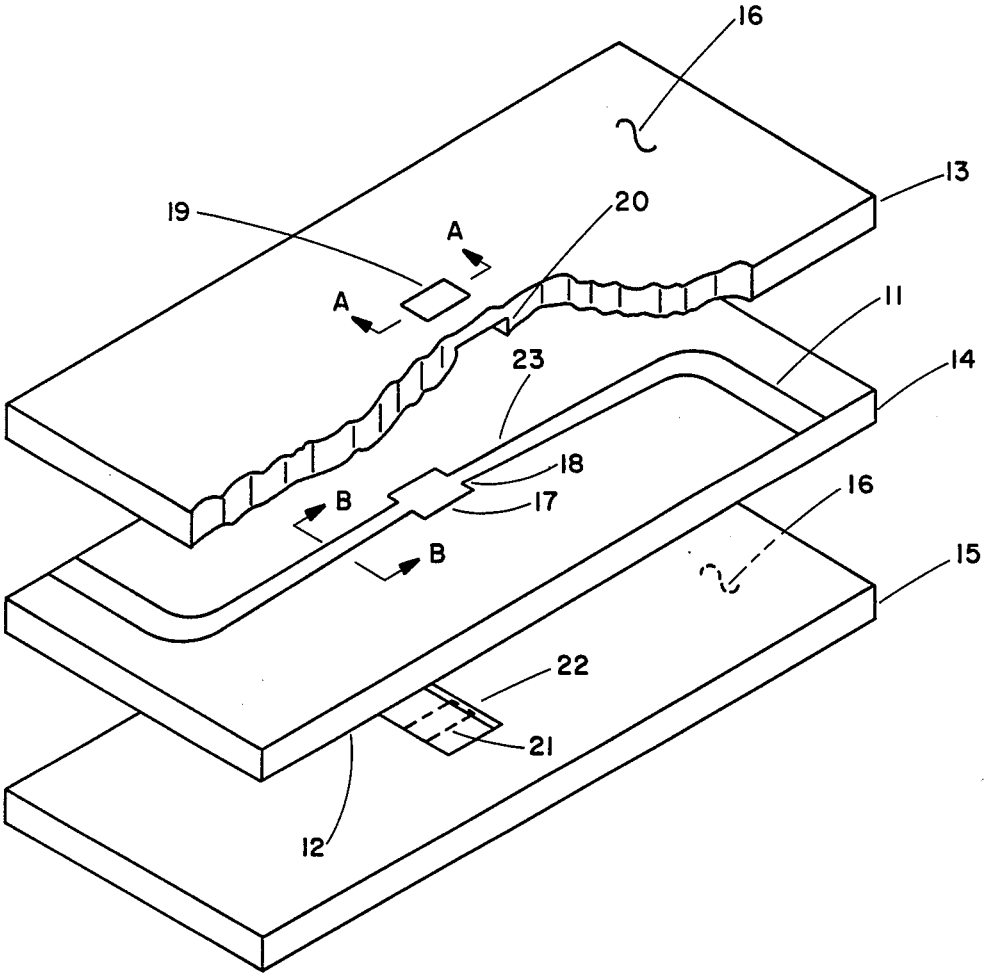
FIG. 8 is an exploded view of the discontinuous-taper coupler showing the relative positions of the three dielectric layers with their constituent elements as the device is assembled.
Figure 9A:
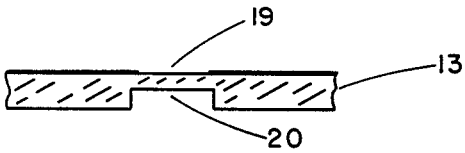
FIG. 9A, FIG. 9B and FIG. 9C show the center dielectric layer with outlines of the coupled lines shown as they appear on the top and bottom in solid lines and dash lines respectively.
Figure 9B:
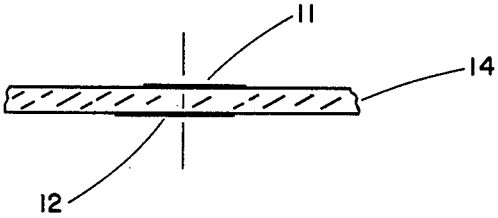
Figure 9C:
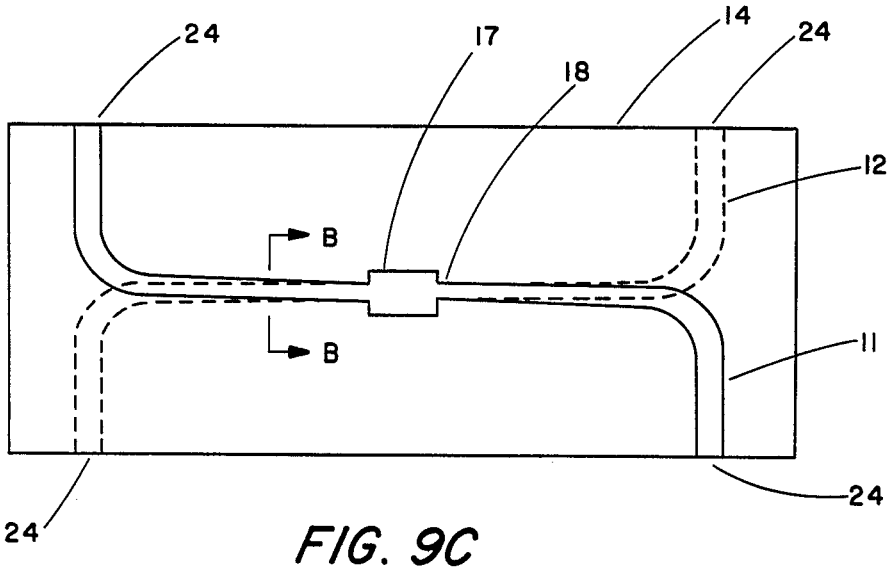

Referring to FIG. 8, the 3-layer construction of the discontinuous-taper coupler is shown in an exploded view which indicates the relative positions of the two outside layers 13,15 and the center layer 14, which is thicker than such layers in the prior art. The center layer 14 supports the flat conductive transmission lines etched with the help of a photographic mask on both sides of 14 as shown in FIGS. 9A, 9B and 9C. Relative dielectric constant of center layer 14 has a value consistent with common practice, while that of top and bottom layers 13,15 is either the same as for the center layer or slightly higher in anticipation of unequal mode velocities in regions of relatively low even-mode impedance. The external surface 16 of both the top and bottom dielectric layers 13,15 is clad with a conductive material to serve as ground planes for the strip line coupler which functions through the interaction of the transmission lines 11 and 12 shown in FIGS. 1A–1C, 8, 9B and 9C.

Discrete sections of line, 17 and 18, are broadside coupled with a geometrically balanced lateral charge distribution. This is in agreement with FIGS. 1A, 2A and 3A.

FIGS. 1 through 7 are included as background material to direct attention to those characteristics of three-layer strip transmission coupled lines which mark the essence of the problems toward which this invention is directed. The first three of these figures relate to lateral charge distribution contours for coupled lines 11 and 12 shown in a pictorial cross section. Three relative positions of the odd-symmetric offset lines are shown in FIGS. 1A, 1B and 1C where the special limiting case of full broadside coupling with balanced lateral charge distribution is evident in the top sketch. Examination of the figures discloses a charge function of the nature of FIGS. 2A, 2B and 2C for small values of s/b, s being stripline separation and b being ground plane separation (see FIG. 1). For larger values of s/b the distribution becomes much smoother as shown in FIGS. 3A, 3B and 3C. Each charge density plot is given as three trajectories (labeled for identification in FIG. 2B as "o" for the odd-mode component, "e" for the even-mode component, and "q" for the sum, or total charge). It will be noted that the odd mode is the more dynamic and erratic of the normal modes while the even mode acts as a rather innocuous vernier control over the coupling coefficient represented in FIGS. 2A, 2B and 2C, and FIGS. 3A, 3B and 3C as calculated normalized even-mode impedance values. Odd-mode perturbations tend to be destructive of the good behavior of the scattering parameters of the coupler.

Figures 1A, 1B, 1C, 2A, 2B, 2C, 3A, 3B, 3C:
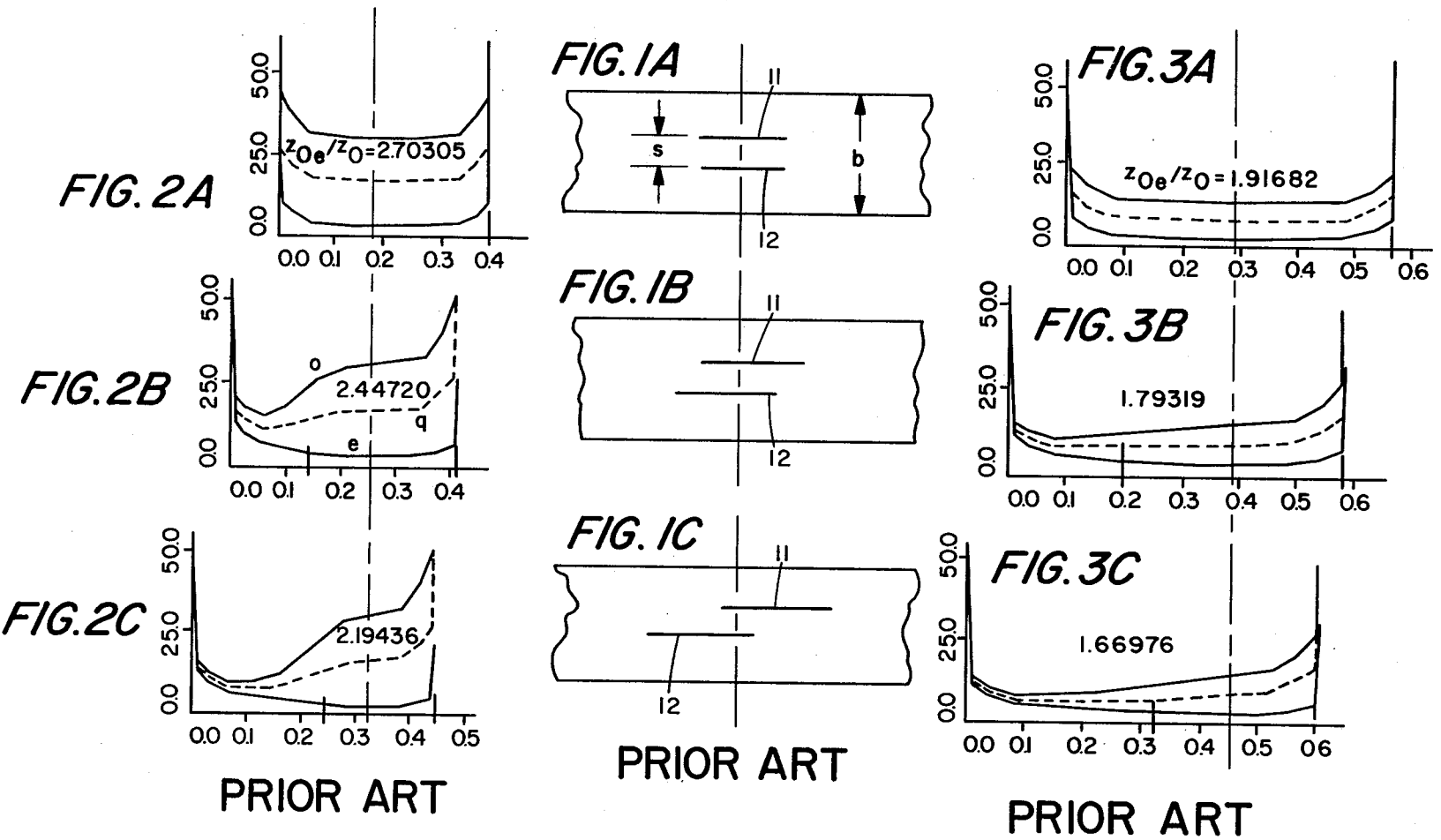
PRIOR ART FIG. 1A
FIG. 1C PRIOR ART
FIG. 1A, FIG. 1B and FIG. 1C are pictorial cross sections showing three relative positions of the odd-symmetric offset lines of the prior art.
FIG. 2A, FIG. 2B and FIG. 2C, and FIG. 3A, FIG. 3B and FIG. 3C graphically illustrate the lateral charge distribution for small values of s/b and for larger values of s/b, respectively, for the prior art device shown in FIG. 1A, FIG. 1B and FIG. 1C, respectively.
Figure 4:
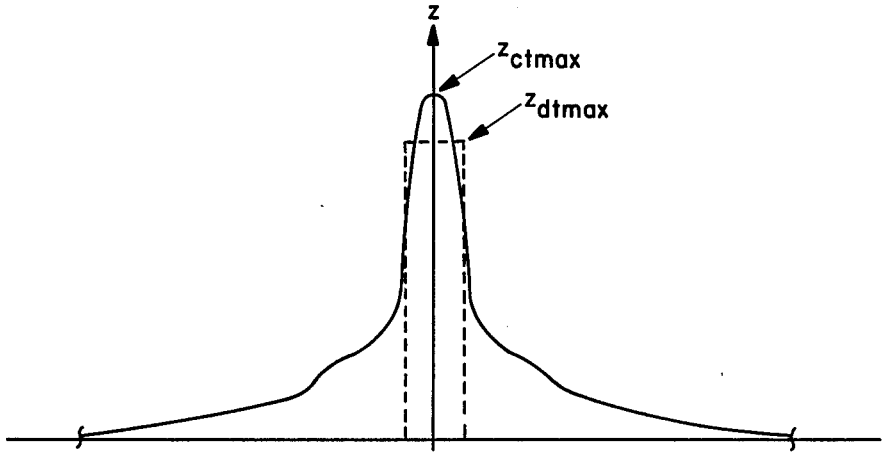
FIG. 4 PRIOR ART
FIG. 4 is a graphic plot of the even-mode impedance function for a prior art quadrature continuous taper coupler.

In FIG. 4, the even-mode impedance for a prior-art quadrature continuous-taper coupler is plotted as a solid line. Maximum impedance is shown as $Z_{ctmax}$. Superimposed over the centrally located smooth spike is a discrete section shown as dashed lines with maximum impedance $Z_{dtmax} < Z_{ctmax}$. This is a first step in the evolution of the discontinuous-taper coupler which is further elaborated in FIG. 5. The impedance function shown in FIG. 5 implicitly encompasses all the elements of the quadrature (90-degree) discontinuous-taper coupler. The short, discrete section at $Z_b$ may be used as an additional parameter to help shape the tapered part of the impedance function. Height (value) and width (extent) of the section at $Z_{max}$ can be varied for optimum shaping of the ground-plane perforation.

Figure 5:
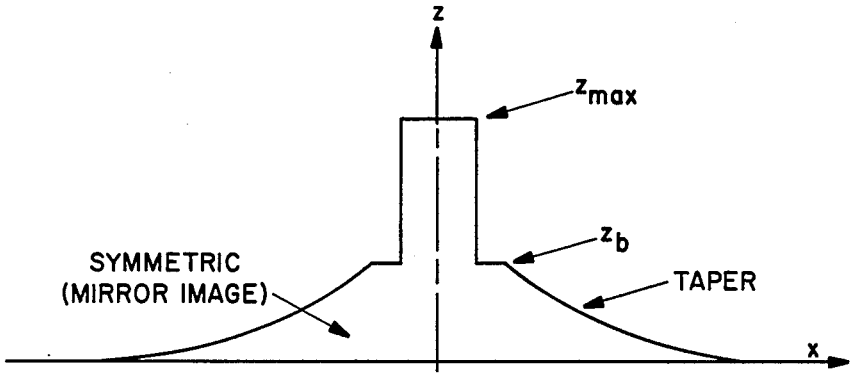
FIG. 5 is a graphic plot of the impedance function for the quadrature discontinuous taper coupler.
Figure 6:
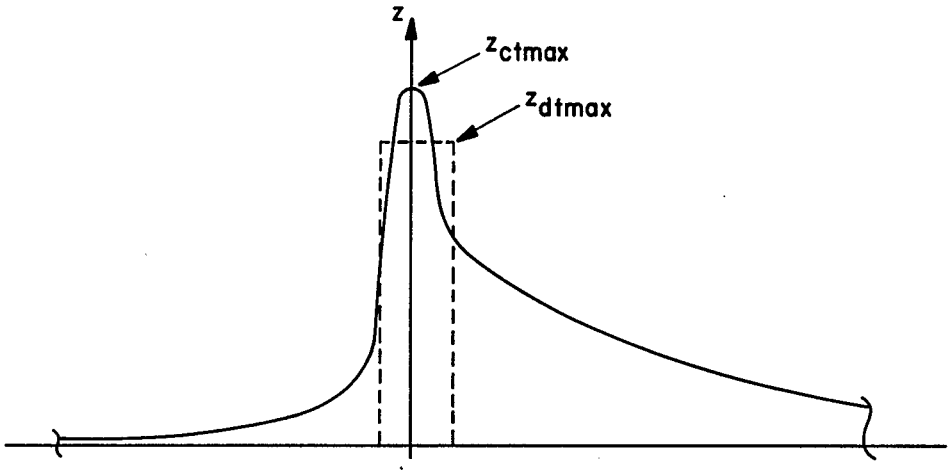
FIGS. 6 and 7 show distribution functions for a more general coupler configuration in which the two sides relative to a central reference axis are designed to be different.
Figure 7:
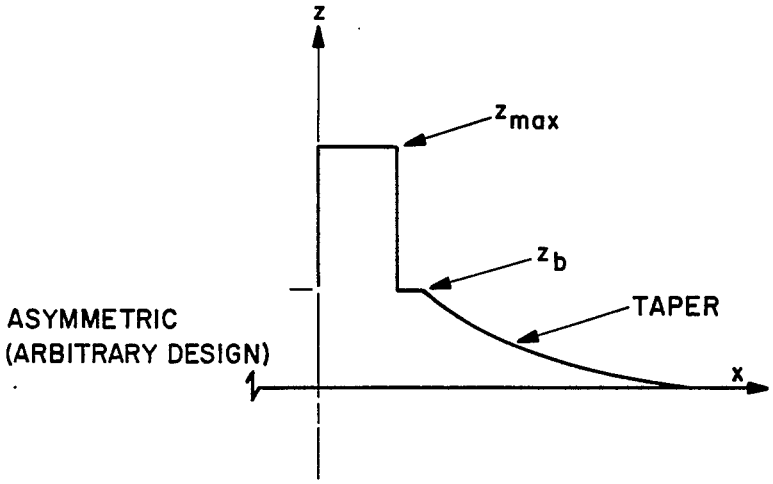

Analagously, FIGS. 6 and 7 show distribution functions as evolved for a more general coupler configuration in which the two sides relative to a central reference axis are designed to be different. The purpose of this conceptual deviation is to provide for arbitrary output differential phases of any value from 0 to 180 degrees (not necessarily restricted to 90 degrees). Other comments with regard to FIGS. 4 and 5 in the preceding paragraph apply as well to FIGS. 6 and 7 respectively.

The discrete section of line 17 shown in FIGS. 8 and 9 corresponds to the maximum even-mode impedance designated as $Z_{max}$ in FIGS. 5 and 7. The discrete section of line 18 shown in FIGS. 8 and 9C corresponds to the short section in FIGS. 5 and 7 at the impedance level $Z_b$ which is the maximum value at broadside coupling for the selected 3-layer dielectric cross section configuration with the ground planes and top and bottom dielectric layers intact.

The abrupt change in even-mode impedance shown in the region of the origins in FIGS. 5 and 7 is evoked as a consequence of the discrete section 17 designed to work in conjunction with the ground plane perforations 19 and 21 and the dielectric material modifications 20 and 22 shown in FIG. 8. Partial removal or replacement of the dielectric material at 20 and 22 reduces the effective dielectric constant in this region. This, together with use of the discrete (not tapered) line segment 17, helps to minimize the size of the perforations 19 and 21 to avoid the effects of a radiating aperture, especially as the frequency increases.

Since, in this region, the unperturbed odd-mode capacitance between the lines is much greater than the even-mode capacitance, the advantage gained in smoothing the lateral current distribution by use of thicker center spacer 14 is preserved. The net effect is a capability for controlling the even-mode and odd-mode capacitances in the critical region independently, which in tantamount to independent control of the coupling and isolation parameters. This has heretofore not been feasible.

The measure of dielectric and ground plane modifications used to establish the maximum coupling value is minimized through the use of discrete section 17 of coupling value by design in the region of maximum coupling. This reduces the maximum required for an equivalent fully tapered component, thus reducing the required areal dimension of the ground plane perforations 19 and 21 and minimizing the likelihood of spatial radiation. Further reduction of the size of ground plane perforations 19 and 21 is achieved as a result of a discrete modification 20, 22 of the dielectric constant in the region of highest coupling. Additionally, a significant latitude is available in the choice of lateral and longitudinal dimensions of the ground plane perforations 19 and 21 if optimization is necessary to avoid possibilities of radiation. This is achieved by discrete choices of maximum coupling coefficient and length of the section 17, which two parameters are not unique to a given set of requirements. A short discrete length 18 of broadside-coupled line with unmodified dielectric or ground plane is also provided adjacent to the section of maximum coupling to provide further latitude in the choice of design parameters.

With the local ground plane modifications and dielectric modifications in place at maximum coupling, the top and bottom dielectric layers 13 and 15 may have a relative dielectric constant slightly higher than that of the center layer 14 for the purpose of equalizing the even- and odd-mode velocities in the extended transmisison line region on either side of the critical high coupling region.

The tapered segment of line 23 is a manifestation of the set of impedance values having a sufficient density in number to approximate a continuous function similar to the taper shown in FIGS. 5 and 7. The final design of the coupler combines the effect of the continuously tapered segment with those of the discrete sections 17,18 which define the discontinuous nature of the function. The device is designed to have a characteristic impedance matched to its transmission line environment with a desired conservative power split and output differential phase. Connections of the coupler to other parts of a microwave circuit are made by means of strip line linking segments or standard external connectors and cables (not shown) joined at the four input/output ports 24 in FIG. 9C.

While particular embodiments of the invention have been shown and described herein, it is not intended that the invention be limited to such disclosure, but that changes and modifications can be made and incorporated within the scope of the claims.

What is claimed is:

1. A discontinuous taper directional coupler comprising:

a dielectric slab of predetermined thickness;

a pair of conductive strip transmission lines etched on opposite sides of said dielectric slab having a discrete discontinuous-taper line segment in each line cooperatively positioned for coupling therebetween;

a pair of dielectric layers, one placed on each side of said slab to form a 3-layer sandwich; and a perforated ground plane on the outside of each dielectric layer sandwiching said dielectric slab, said perforations corresponding to the discontinuous-taper line segments of said strip transmission lines.

2. The coupler of claim 1 wherein each of said dielectric layers has part of its dielectric material modified intermediate said ground plane perforations and said discontinuous-taper line segments such that the effective dielectric constant is reduced in the region.

3. The coupler of claim 2 wherein said dielectric slab is proportionately too thick to allow maximum local coupling between said conductive strip lines without said ground plane perforations and said effective dielectric constant reduction.

4. The coupler of claim 2 wherein each of said dielectric layers are homogenous and of a higher effective relative dielectric constant outside said region of reduced dielectric constant.

5. The coupler of claim 2 wherein the coupling distribution is asymmetrical about a central point, thus having a predetermined output differential phase response within a range from −90 to +90 degrees.

6. The coupler of claim 2 wherein each of said discontinuous-type line segments is a finite uniform constant coupling section.

7. The coupler of claim 2 further comprising a short discrete length of broadside coupled line provided adjacent to said discontinuous-type line segments.

* * * * *